United States Patent [19]

Timmerbeil

[11] 4,204,381

[45] May 27, 1980

[54] BANDING MACHINE, IN PARTICULAR FOR BANDING BUNDLES OF BANK NOTES

[75] Inventor: Karl E. Timmerbeil, Ennepetal, Fed. Rep. of Germany

[73] Assignee: Weka-Handelsgesellschaft m.b.H., Austria

[21] Appl. No.: 938,338

[22] Filed: Aug. 31, 1978

[30] Foreign Application Priority Data

Sep. 12, 1977 [AT] Austria ..... 6517/77

[51] Int. Cl.[2] ..... B65B 11/52; B65B 13/18

[52] U.S. Cl. ..... 53/528; 53/228; 53/553; 53/586

[58] Field of Search ..... 53/528, 582, 586, 590, 53/228, 529, 553

[56] References Cited

U.S. PATENT DOCUMENTS

| | | | |
|---|---|---|---|
| 2,982,063 | 5/1961 | Coleman et al. | 53/528 X |
| 3,307,326 | 3/1967 | Krebs | 53/528 X |
| 3,580,786 | 5/1971 | Doane et al. | 53/586 X |
| 3,650,087 | 3/1972 | Brinkmeier et al. | 53/528 |
| 3,720,040 | 3/1973 | Rocker | 53/586 X |
| 3,879,944 | 5/1975 | Heywood et al. | 53/586 X |

*Primary Examiner*—John Sipos

*Attorney, Agent, or Firm*—McGlew and Tuttle

[57] ABSTRACT

A banding machine for banding bundles of bank notes, by means of ribbons of material, which are drawn off two supply rollers by the material to be packed, which has been inserted into the machine, and pass above and beneath the material to be packed to a sealing and cutting device, which forms a closing sealing seam for the material to be packed. Bundles of different size can be handled because moveable stops move the bundle into a precise operating position.

8 Claims, 6 Drawing Figures

BANDING MACHINE, IN PARTICULAR FOR BANDING BUNDLES OF BANK NOTES

BACKGROUND OF THE INVENTION

1. Field of the Invention

The invention relates to a banding machine, in particular for banding bundles of bank notes by means of ribbons of material, which are drawn off two supply rollers by the material to be packed, which has been fed into the machine, and travel above and beneath the material to be packed to a sealing and cutting device, which forms a closing sealing seam for the material to be packed, which material is held down by a pressing member, separates the two ribbons behind this sealing seam and joins them to one another by means of a second sealing seam.

2. Description of the Prior Art

A machine of this kind is disclosed in AT-PS 267.411, in which there is provided in a first station a plate-shaped carrier, provided with a recess, for the material to be packed, which carrier can be moved in the horizontal plane of operation to a second station, in which the sealing and cutting bars are arranged, whereby the packaging sleeve is entrained by the material to be packed or the carrier and a pressing member is disposed in the second station above the material to be packed and opposite the recess of the carrier advanced to this station, which pressing member holds the material to be packed in position during the withdrawal of the carrier acting as an insertion member out of the sleeve.

A machine of this kind, wherein the material to be packed lies loosely on the moveable carrier, is moved into a position underneath a pressing member by this carrier and held there while the carrier withdraws in order to permit the sealing process to be carried out, is scarcely suitable for banding bundles of bank notes. In providing a solution to this problem, it is important above all to form an exactly aligned bundle at the beginning of the banding process, which retains its shape exactly during its displacement into the operating position during the sealing together of the sheets. At the same time a difficult demand is placed upon a banding machine for banding bank notes in that this machine must be able to process bundles of varying thicknesses and widths without being readjusted each time.

SUMMARY OF THE INVENTION

The invention fulfils these requirements in that moveable stops are provided on both sides of a fixed carrier plate for moving the material to be packed into the operating position.

The stops do not merely serve here to align the individual notes exactly above one another at the beginning of the operating process, but the respective positions of the stops also define the position of the reverse side or trailing edge of the bundle or stack to be packed, independantly of its width. In order to locate the sealing seam in the correct position, the sealing and cutting device is triggered or actuated when the stops are in the region of the sealing and cutting device.

It is preferably arranged that the stops also form a support means for the bundle of bank notes during the sealing process. The short period of stay of the stops in the region of the sealing and cutting device, which is necessary for this, is achieved most simply if the point of reversal of the movement of the stops is located in this region.

In order to ensure that the ribbons forming the banding material lie smoothly against the material to be packed, it is advantageous to apply pressure to the bundle to be encircled as soon as it begins to move into the operating position by means of a pressing member. This pressing member preferably rests on the material to be packed with its own weight only. The pressing member must be able to withdraw in an upward direction upon the insertion of a relatively thick bundle. It is also possible to spring load the pressing member downwardly.

In a preferred embodiment, the pressing member is driven by way of a cam disc disposed laterally thereto. To ensure nevertheless that the pressing member retains its horizontal position, the pressing member may be mounted by two links of a parallelogram arrangement, upon which the cam disc acts at least during its upward movement.

A lower ribbon of banding materials runs underneath the fixed carrier plate for the bundle to be packaged as far as the sealing point, from which point it is drawn further virtually in its own longitudinal direction by means firstly of the insertion of the material to be packed. No particular problems arise here. One should ensure, however, that a upper ribbon is already running tautly over the upper surface of the material to be packed, when the pressing member lowers itself onto the material to be packed. This is achieved by providing a slit or aperture in the pressing member for guiding the upper ribbon, the upper ribbon being drawn downwardly through the slit.

It is an object of the invention to provide an apparatus for banding a stack of bank notes including support means for supporting the stack and means defining a sealing station along a conveying path for conveying the stack. The conveying means is movable over the conveying path for conveying the stack over the sealing station. Means are provided for extending a length of banding material across the path such that the conveying means moves the stack into engagement with the banding material as the banding material moves with the stack across the sealing station. A sealing and cutting device disposed along the path has sealing means for sealing a predetermined length of the banding material together and has cutting means disposed intermediate to the sealing means for transversely cutting the banding material intermediate the predetermined length. Actuating means connected to the sealing and cutting device are provided for sealing and cutting the banding material. The conveying means is movable to a position in alignment with the cutting means for actuating the sealing and cutting device and for simultaneously providing another length of banding material across the conveying path.

It is a further object of the invention to provide a conveying means having at least two spaced-apart conveying members or stops movable along the conveying path. It is a further feature of the invention that the sealing and cutting device disposed along the conveying path has successively arranged upper sealing jaws overlying the conveying path at successively arranged lower sealing jaws underlying the conveying path and cutting means arranged between the successively arranged sealing jaws and further that the upper and lower sealing jaws are opposed and movable in respect to each other. In addition, the means for extending a length of banding material may include a first and second supply of banding material mounted on the support means, the first and second supply of banding material having a first end sealingly joined to each other adjacent the lower sealing jaw so that a length of the banding material is extended across the conveying path. It is still a further feature of the invention that each of the conveying members may be movable along the conveying path on opposite sides of the sealing and cutting device to an aligned position with the cutting means being interposed proximate a line between the conveying members. The conveying members are movable in engagement with the trailing edge of the stack such that the stack moves in engagement with the banding material. In a preferred embodiment, the actuating means is operative in the aligned position to move the jaws together for sealing the predetermined length of banding material and for transversely cutting the banding material across the predetermined length.

For an understanding of the principles of the invention, reference is made to the following description of typical embodiments thereof as illustrated in the accompanying drawings.

BRIEF DESCRIPTION OF THE DRAWINGS

Additional features of the invention are described in the following description of an embodiment. This embodiment is shown in perspective in FIG. 1, while

DESCRIPTION OF THE PREFERRED EMBODIMENTS

Figures 1, 6:
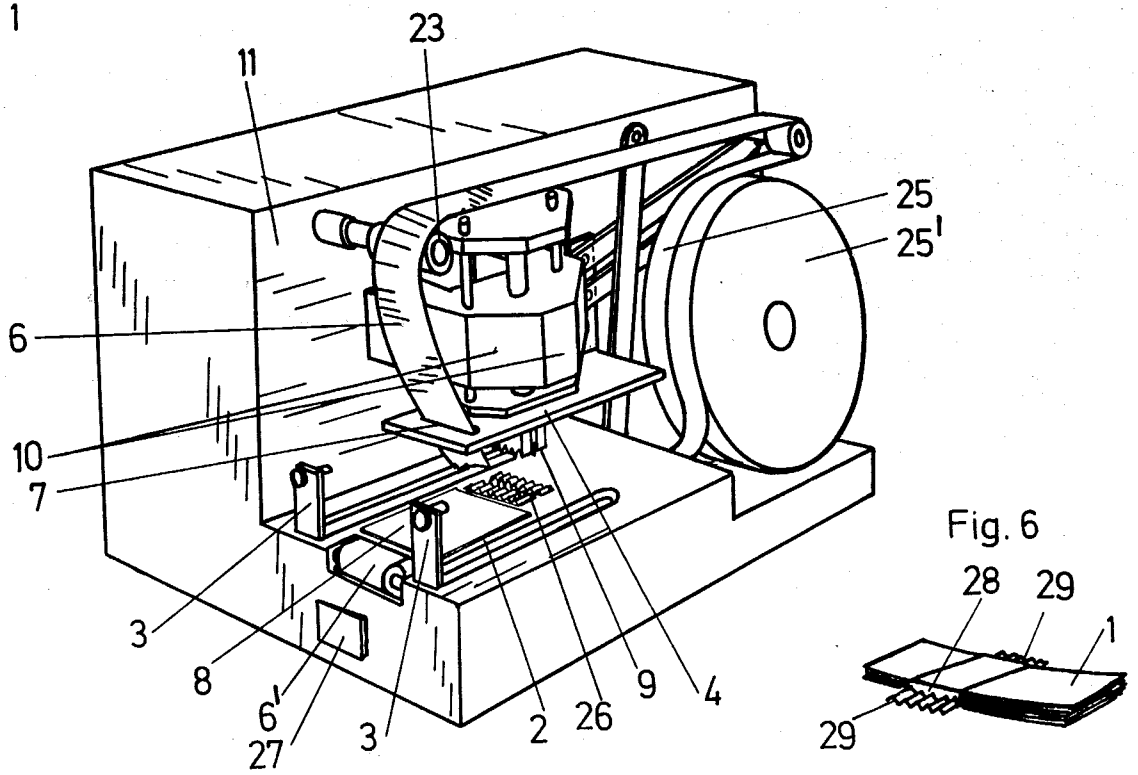
FIG. 6 is a perspective view of the bundled material to be packed.

Referring now to the drawings, in particular, the invention embodied therein comprises an apparatus for banding a stack of bank notes or the like. The apparatus includes a stationary means for supporting the stack and a sealing or banding station for banding and sealing the stack with a banding material. In the perspective illustration of FIG. 1, a conveying means for conveying the stack through a conveying path to the sealing station includes two spaced-apart conveying members or stops 3 which are movable along the conveying path along appropriate sides of a sealing and cutting device or jaw 9 disposed along the conveying path. The machine illustrated in perspective view in FIG. 1 is divided up by means of a vertical plate 11, whereby the drive side is located behind the plate and the operating side in front of the plate. The task of the machine is to join together in the sealing and cutting device a respective upper ribbon 6 and a respective lower ribbon 6' of banding material, which ribbons are drawn off supply rollers 25 and 25' by way of guide rollers 23 and 23'. The joining should be effected in such a manner that a band 28, illustrated in FIG. 6 is formed, which consists of a respective portion of the upper ribbon 6 and of the lower ribbon 6', joined to one another on both sides by sealing seams 29. In the illustrated example, a predetermined length of the two ribbons 6, 6' are joined together by cold sealing, i.e. the ribbons are coated on their sides facing one another with a material which joins them together when they are pressed firmly against one another. The per se known cutting and sealing jaw 9 serves to press together the ribbons 6, 6', whose ends have been broken away in the view illustrated in FIG. 1, so that they do not obscure the view of the cutting and sealing device. This jaw 9 consists of two successive rows of teeth, which together with corresponding stops 26 form the sealing seams 29, and of a cutting edge disposed between the successive rows of teeth. The cutting edge severs the predetermined length of the ribbons 6, 6' joined to one another across sealing seams 29 produced in the same operating cycle. In the resting position, the sealing jaw 9 is partially withdrawn into a housing 10 secured to the wall 11, from which housing it moves rapidly downwards due to the action of a compression spring 24 during the sealing operation. The illustrated machine is actuated in a manner, as is to be described in more detail with reference to FIGS. 2 to 5, whereby a bundle of paper strips, in particular bank notes, is laid on the receiving surface 8, consisting of PTFE or a similar low friction material, of the fixed carrier plate 2 and is aligned with the stops 3. The ends (not illustrated) of the ribbons 6, 6' are already joined to one another at this stage and still adhere loosely to the forward stop 26. The stops 3 are set in motion by pressing a button 27. The stops 3 move the bundle of bank notes over and beyond the stops 26, while it is compressed by a pressing member 4. During its forward movement, the material to be packed 1 draws the joined ends of the ribbons 6, 6' with it so that it is surrounded on three sides by the ribbons 6, 6', when the cutting and sealing jaws are actuated to form the closing sealing seam and to separate the completed bundle from the remaining portion of the ribbons 6, 6' which are simultaneously joined to one another.

Figure 3:
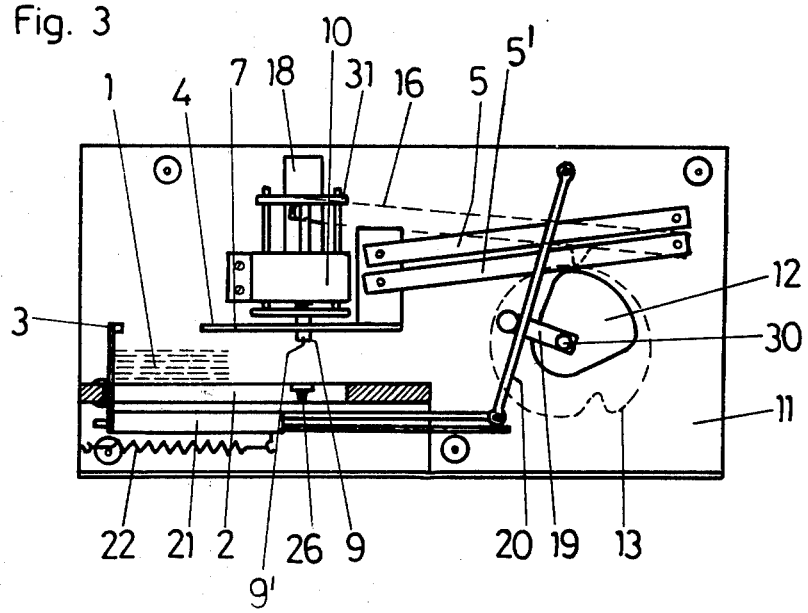
Figure 4:
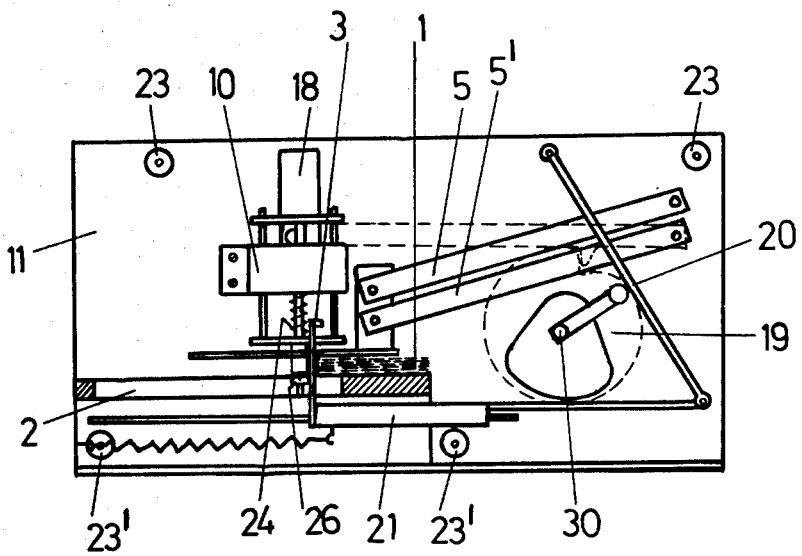
Figure 5:
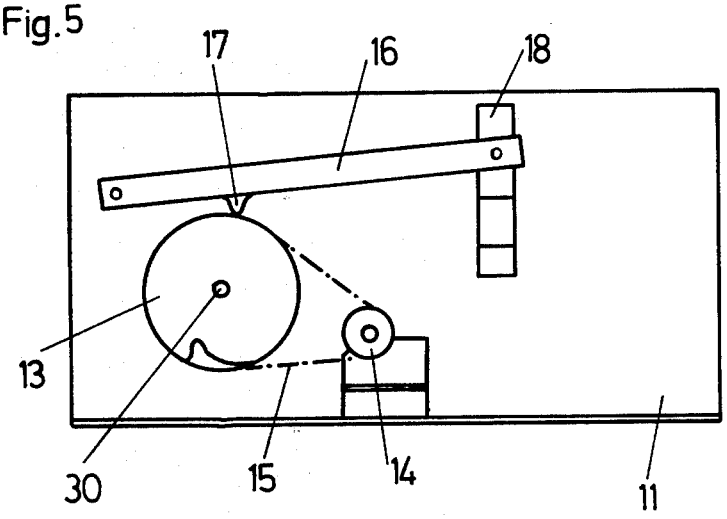

FIG. 3 shows in schematic section the initial position, in which the bundle of bank notes to be packaged is deposited on the carrier 2 and aligned with the stops 3. As can be seen in Figure, the ribbons 6, 6', which for the sake of clarity are no longer shown in FIGS. 3 and 4, respectively, pass in this position from the supply rollers 25, 25' by way of guide rollers 23, 23' beneath the carrier plate 2 on the one hand, and through an aperture 7 in the pressing member 4 on the other hand to the stop 26 for the cutting and sealing jaw 9. At this point they are joined to one another by means of a sealing seam produced in the previous operating cycle. The pressing member 4, which is held in its horizontal position by parallel links 5 and 5' is in its upper limit position, as is the cutting and sealing jaw, which has been withdrawn into the housing 10.

Figure 2:
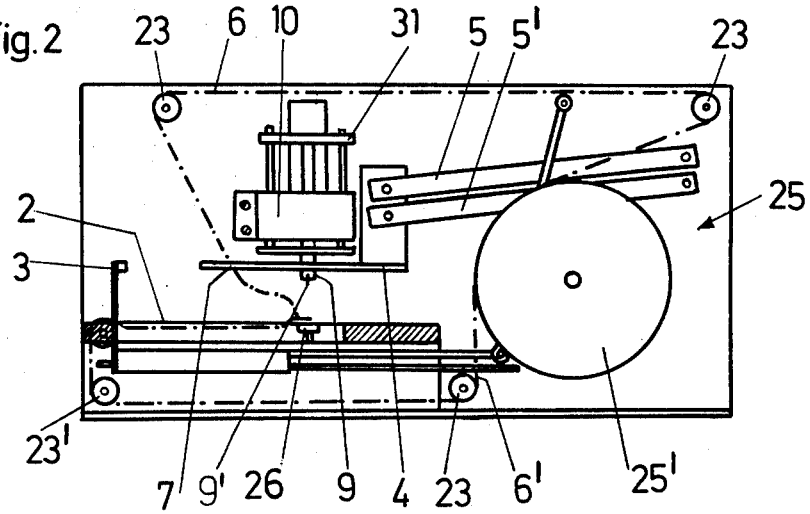
FIGS. 2 to 4 show the operating side of the machine in various stages of movement and FIG. 5 shows the drive side in the initial position.

FIG. 3 shows how the individual members of the machine are held in their position according to FIG. 2, but wherein the paper webs have been omitted so that the mechanisms can be seen. The stops 3 are mounted on a slide 21, which can be displaced to the right by means of a draw rod 20 by way of a connecting rod 19, in opposition to which a return spring 22 acts to draw the slide 21 as far to the left as the connecting rod will permit. A cam disc 12 is provided on the same shaft as the connecting rod 19 and is firmly connected thereto. The cam disc 12 presses the parallel links 5 and 5', and with them the pressing member 4, upwards. The upper position of the cutting and sealing jaw 9 is obtained by a lever 16, which is mounted on the drive side of the machine illustrated in FIG. 5. The lever 16 acts through an aperture 18 of the wall 11 on a frame 31 of the sealing and cutting jaw, which is guided vertically in the housing 10. The lever 16 is moved, as can be seen in particular from FIG. 5, by way of a cam disc 13, which cooperates with a cam 17 and is located on the same driveshaft 30 of the cam disc 12 and the connecting rod 19. The common drive of all these moveable elememts of the machine is carried out by way of a motor 14 by means of a chain 15. When the material to be packed 1, as illustrated in FIG. 3, is arranged in layers in a bundle, the machine is started up by pressing the button 27 which sets the motor 14 in motion. The slide 21 is then drawn forward on the one hand by the interaction of the rotating shaft 30, connection rod 19, draw rod 20 and slide 21 so that the stops 3 displace the material to be packed 1 while entraining the joined together ends of the ribbons 6, 6'. At the same time, the pressing member 4 is lowered onto the material to be packed 1 by way of the cam disc 12. The material to be packed 1 is, in the present case, only subject to the weight of the pressing member 4 and to the partial weight of the parallel links 5, 5'. Naturally, this loading could be increased by the addition of a spring.

When the stops 3 are in their foremost position, the cam disc 13 releases the lever 16 in a sudden manner, whereupon the compression spring 24 forces the cutting and sealing jaw 9 downwards. A closing sealing seam is hereby formed behind the material to be packed 1, which is held in position by the stops 3, by means of which sealing seam the band 28 is completed and at the same time the ends of the ribbons 6, 6', are joined to one another anew in preparation for the next operating cycle. The joined ribbons are severed more or less completely as required between the two adjacent sealing seams 29, thus permitting the banded material to be removed. The stops 3 are illustrated in a position in FIG. 4 for clarity of illustration, which would lead to the production of a relatively loose band 28. In practice, the path of the stops 3 is so adjusted that they are virtually on a line with the sealing and cutting jaw 9 during the sealing process and thereby tends to produce a relatively tight band. The rotation of the shaft 30 is terminated by a limit switch (not shown) as soon as the stops 3 are in the initial position once more, as illustrated in FIGS. 2 and 3.

The illustrated machine fulfils both requirements, which must be satisfied if a band is to be produced which lies tautly around the bundle of bank notes. On the one hand the bundle of bank notes is compressed to a relatively solid block during the entire cycle of movement by means of the pressing member 4, which block entrains the band material under tension, so that this material lies closely against the bundle, on the other hand the rear or trailing edge of the bundle of bank notes is positioned as closely as possible adjacent the sealing jaw by means of the stops 3 and, in accordance with the invention, is held in position during the sealing process. Such an exact positioning is not possible in the known machines, wherein the carrier for the material to be packed is withdrawn, so that there would always be the risk of individual bank notes finding their way beneath the sealing jaw and thus producing a faulty package or damaging the bank notes.

The use of banding material with an inner cold sealing covering is particularly advantageous since this not only permits a simple mechanical joining of the two portions of the band but also prevents the band from slipping off due to the high level of adhesion between the band and the material to be packed.

The fin-like sealing seams formed during the sealing process provide a good contact point for the hand during removal of a band or the removal of individual bank notes from the bundle. If, on the other hand, the bands are to be torn off, then the sealing seams represent a breaking point, since they act in a manner similar to that of tear-open perforations.

While specific embodiments of the invention have been shown and described in detail to illustrate the application of the principles of the invention, it will be understood that the invention may be embodied otherwise without departing from such principles.

I claim is:

1. An apparatus for banding a stack of bank notes comprising a stationary carrier member having a feeding station and a banding station, means for conveying said stack lying parallel to said carrier member along a conveying path from said feeding station to said banding station, a pressing member overlying said path having ends in the direction of said conveying path operatively connected to said conveying means and including means for moving said pressing members downward to said carrier member for compressing said stack in said banding station, a first and second supply of banding material, a sealing and cutting device having one pair of successively arranged upper sealing jaws overlying the conveying path and located intermediate said ends of said pressing member, one pair of successively arranged lower sealing jaws underlying the conveying path and means for cutting said banding material being arranged between said successively arranged sealing jaws means for moving said upper and said lower pair of sealing jaws in respect to each other, at least one of said pairs of jaws being movable in respect to said pressing member, said pressing member having means for guiding said first supply of banding material through said members intermediate said ends above the conveying path of said stack to said sealing and cutting device, said second supply of banding material being fed to said sealing and cutting device below said conveying path of said stack, said conveying means having stops arranged on both sides of said carrier member for engaging the trailing edge of said stack, said stop means being movable from said feeding station to a position adjacent said sealing and cutting device.

2. An apparatus according to claim 1, wherein said pressing member and said conveying means are operatively connected by cam means, said cam means releasably engaging said conveying means and pressing member, said pressing member being cleared for compressive movement in the course of the movement of said stack to said banding station.

3. An apparatus according to claim 1, wherein said means for guiding said first supply of banding material includes an aperture arranged adjacent to said upper pair of sealing jaws, said first banding material passing through said aperture.

4. An apparatus according to claim 1, wherein said conveying means further includes a slide, and a spring attached to said slide and said carrier member, said stops being mounted on said slide, said slide being movably arranged below said carrier member and pretensioned in the direction of said feeding station by means of said spring.

5. An apparatus according to claim 1, further comprising a cam means for releasably engaging said pressing member and said conveying means, said cam means being operative to engage said pressing member and said conveying means outside said sealing station.

6. An apparatus according to claim 1, further comprising a plurality of links mounted on said support means and connected to said pressing member, a cam means for releasably engaging at least one of said links and said conveying means outside said sealing station.

7. An apparatus according to claim 1, wherein said pressing member includes an aperture, and at least one supply of said banding material passing through said aperture.

8. An apparatus according to claim 1, wherein said conveying means includes a slide member, spring means connected to said slide member and said support means, and rod means connected to said slide means, said conveying member being mounted on said slide means, and further comprising a cam means for releasably engaging said pressing member and said rod means.

* * * * *